US009746202B2

(12) United States Patent
Takemoto

(10) Patent No.: US 9,746,202 B2
(45) Date of Patent: Aug. 29, 2017

(54) DRYER

(71) Applicant: Nidec Corporation, Kyoto (JP)

(72) Inventor: Shinji Takemoto, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 436 days.

(21) Appl. No.: 14/554,163

(22) Filed: Nov. 26, 2014

(65) Prior Publication Data

US 2015/0192324 A1 Jul. 9, 2015

(30) Foreign Application Priority Data

Jan. 6, 2014 (JP) ..... 2014-000177

(51) Int. Cl.

| | |
|---|---|
| ***A45D 20/10*** | (2006.01) |
| ***A45D 20/12*** | (2006.01) |
| ***F24H 3/04*** | (2006.01) |
| ***H05B 3/16*** | (2006.01) |
| ***F24H 9/00*** | (2006.01) |

(52) U.S. Cl.
CPC ..... *F24H 3/0423* (2013.01); *A45D 20/10* (2013.01); *F24H 9/0073* (2013.01)

(58) Field of Classification Search
None
See application file for complete search history.

(56) References Cited

U.S. PATENT DOCUMENTS 1,564,896 A * 12/1925 Truman ..... A45D 20/10 338/305
2,651,705 A * 9/1953 Clemens ..... A47K 10/48 219/512
3,094,606 A * 6/1963 Ferris ..... B44D 3/168 219/228
3,209,988 A * 10/1965 Fox ..... F24H 3/0423 392/384
3,211,891 A * 10/1965 Kendall ..... F24H 3/0405 338/280
3,426,441 A * 2/1969 Broski ..... A45D 20/30 219/501
3,610,881 A * 10/1971 Stewart ..... F24H 3/0423 219/400
3,674,980 A * 7/1972 Cox ..... A45D 20/18 165/103

(Continued)

FOREIGN PATENT DOCUMENTS

JP 2006-181297 A 7/2006

*Primary Examiner* — Thor Campbell
(74) *Attorney, Agent, or Firm* — Keating & Bennett, LLP

(57) ABSTRACT

A dryer includes a centrifugal impeller, a motor configured to rotate the impeller about a rotation axis which crosses a plane including a blowing axis, and a heater. The impeller is accommodated in a portion including a pair of side surfaces, each of which crosses the rotation axis, and an air inlet defined in at least one of the side surfaces. The impeller includes blades that are annular with the rotation axis as a center. The heater is supported on plate-shaped portions extending in a plurality of directions from the blowing axis in a cross-section perpendicular or substantially perpendicular to the blowing axis. A rear edge of each of the plate-shaped portions with respect to the blowing axis extends in a direction which crosses radially outer edges of the blades with respect to the rotation axis when viewed along the blowing axis.

15 Claims, 9 Drawing Sheets

(56) References Cited

U.S. PATENT DOCUMENTS 4,019,260 A * 4/1977 Levy ..... A45D 20/124 239/389
4,090,061 A * 5/1978 Glucksman ..... F24H 3/0405 338/294
4,122,329 A * 10/1978 Godel ..... A45D 20/10 219/541
4,198,558 A * 4/1980 Benty ..... A45D 20/12 132/212
4,225,775 A * 9/1980 Carter ..... H05B 3/16 219/532
4,232,454 A * 11/1980 Springer ..... A45D 20/122 239/455
4,350,872 A * 9/1982 Meywald ..... H05B 3/46 219/532
4,370,544 A * 1/1983 Fujishima ..... A45D 20/30 200/50.28
4,443,689 A * 4/1984 Muller ..... D02J 13/005 165/89
4,471,213 A * 9/1984 Yoshida ..... A45D 20/12 219/532
4,647,757 A * 3/1987 Haastrup ..... H05B 3/16 132/212
4,735,002 A * 4/1988 Rath ..... A45D 20/08 34/97
4,827,105 A * 5/1989 Brown, Jr. ..... A45D 20/12 219/222
5,144,757 A * 9/1992 Sasso ..... F04D 29/4226 34/96
5,148,512 A * 9/1992 Owens ..... F24H 3/0423 132/212
5,216,822 A * 6/1993 Madiedo ..... F26B 21/003 34/82
5,490,336 A * 2/1996 Smick ..... A45D 20/12 34/82
5,875,562 A * 3/1999 Fogarty ..... A45D 20/10 34/97
D439,372 S * 3/2001 Yip ..... D28/13
8,607,470 B2 * 12/2013 Richmond ..... A45D 20/10 34/100

* cited by examiner

DRYER

BACKGROUND OF THE INVENTION

1. Field of the Invention

The present invention relates to a dryer.

2. Description of the Related Art

Dryers designed to dry or heat objects by blowing hot air are known. Such a known dryer is described, for example, in JP-A 2006-181297. In a hair dryer described in JP-A 2006-181297, an air blowing unit and a heating mechanism are arranged inside a tubular body case (see claim 1 of JP-A 2006-181297). The air blowing unit includes a turbofan which is a centrifugal fan (see paragraph [0040] of JP-A 2006-181297). Meanwhile, the heating mechanism includes an insulating frame arranged on a side of the turbofan closer to an air outlet, and a heater wrapped spirally around the insulating frame (see paragraph [0045] of JP-A 2006-181297).

In order to increase the volume of air sent by a dryer, it is necessary to rotate a fan of the dryer at a higher speed. However, in the hair dryer described in JP-A 2006-181297, for example, a large number of members, such as the insulating frame and the heater, are arranged downstream of the fan inside the body case. This hair dryer has a problem in that, if the fan is rotated at a high speed, a large amount of noise is caused by interference of the airflow generated by the fan with other members.

SUMMARY OF THE INVENTION

A dryer according to a preferred embodiment of the present invention is a dryer arranged to send hot air forward along a blowing axis extending in a front-rear direction. The dryer includes a tubular portion extending in the front-rear direction around the blowing axis extending in the front-rear direction; an impeller accommodating portion rearward of the tubular portion and continuous with the tubular portion; a centrifugal impeller accommodated inside the impeller accommodating portion; a motor configured to rotate the impeller about a rotation axis which crosses a plane including the blowing axis; a heater support portion located inside the tubular portion; and a heater supported by the heater support portion inside the tubular portion. The impeller accommodating portion includes a pair of side surfaces each of which crosses the rotation axis, and an air inlet defined in at least one of the side surfaces. The impeller includes a plurality of blades preferably having an annular or substantially annular shape with the rotation axis as a center. The heater support portion includes a plurality of plate-shaped portions extending in a plurality of directions from the blowing axis in a cross-section perpendicular or substantially perpendicular to the blowing axis. A rear edge of each of the plate-shaped portions of the heater support portion with respect to the blowing axis extends in a direction which crosses radially outer edges of the blades with respect to the rotation axis when viewed along the blowing axis.

According to the above preferred embodiment of the present invention, the radially outer edge of each blade and the rear edge of each of the plate-shaped portions of the heater support portion are not parallel or not substantially parallel to each other when viewed along the blowing axis. Thus, noise caused by interference of an airflow sent forward from each blade via any of the plate-shaped portions is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the accompanying drawings. It is assumed herein that a "blowing axis" is defined along a direction in which a dryer generates an airflow. It is also assumed herein that a downstream side and an upstream side (with respect to the airflow) along the blowing axis are defined as a front side and a rear side, respectively. It should be noted, however, that the above definitions of a front-rear direction and the front and rear sides are not meant to restrict in any way the orientation of a dryer according to any preferred embodiment of the present invention when in use.

Figure 1:
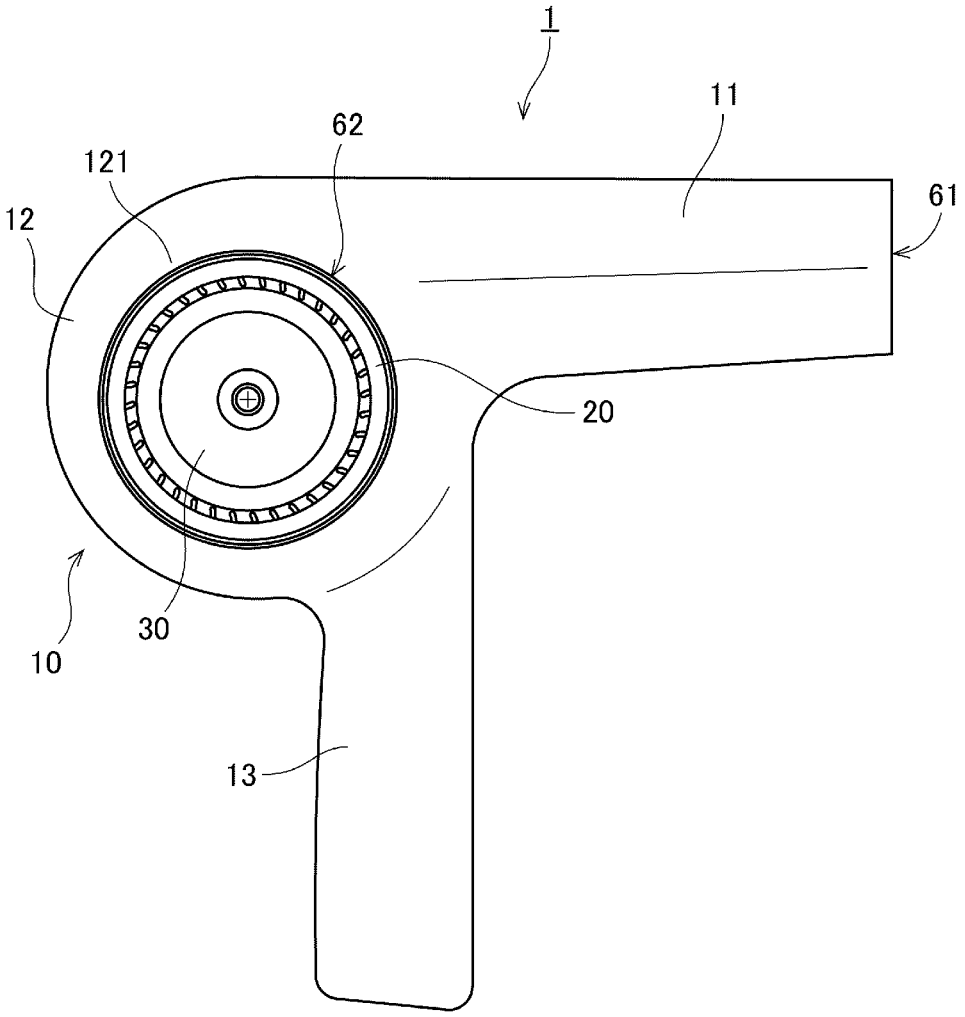
FIG. 1 is a side view of a dryer according to a preferred embodiment of the present invention.
Figure 2:
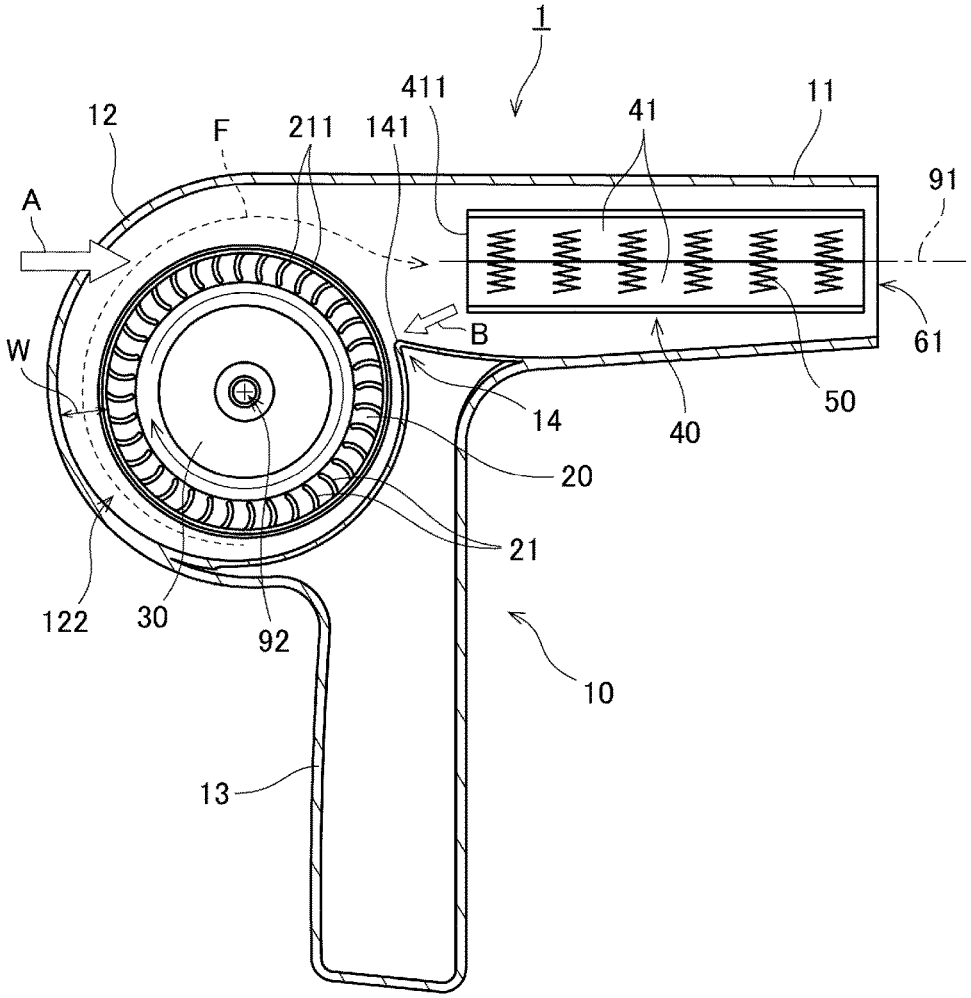
FIG. 2 is a vertical cross-sectional view of the dryer.
Figure 3:
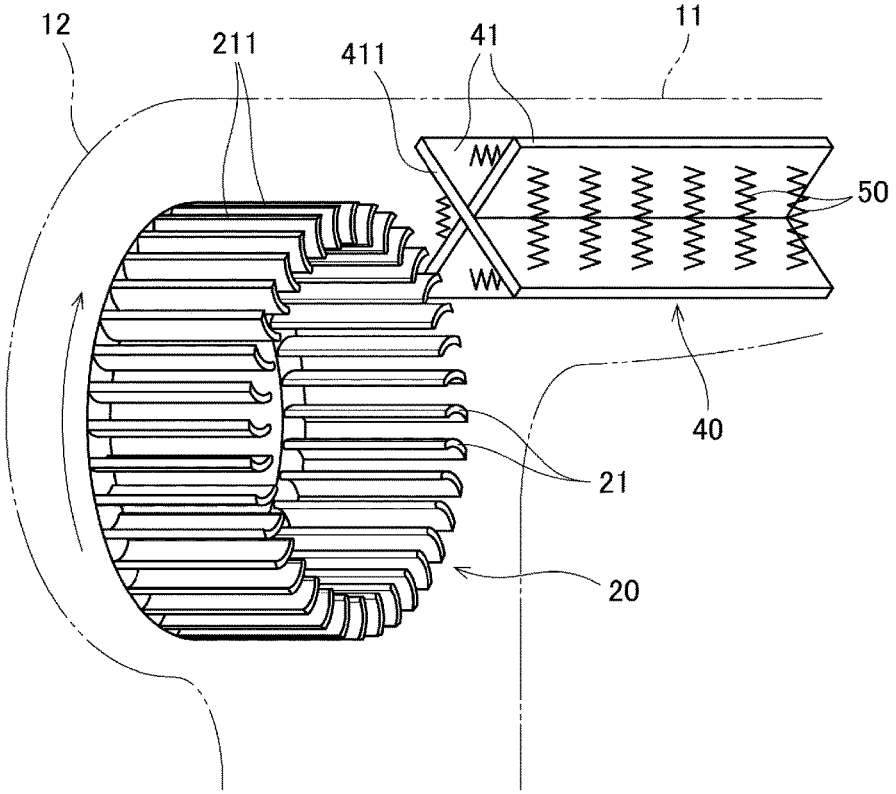
FIG. 3 is a perspective view illustrating an internal structure of the dryer.

FIG. 1 is a side view of a dryer 1 according to a preferred embodiment of the present invention. FIG. 2 is a vertical cross-sectional view of the dryer 1. FIG. 3 is a perspective view illustrating an internal structure of the dryer 1.

The dryer 1 is an apparatus configured to direct hot air forward by rotating an impeller 20 with a motor 30. The dryer 1 is preferably used, for example, as a household hair dryer, a hair dryer for professional use to dry hair, etc. Note, however, that dryers according to preferred embodiments of the present invention may be dryers designed to dry or heat objects other than hair, e.g., industrial dryers, heat guns, etc. Referring to FIGS. 1 to 3, the dryer 1 according to the present preferred embodiment preferably includes a housing 10, the impeller 20, the motor 30, a heater support portion 40, and a heater 50. The impeller 20 is preferably a centrifugal impeller, for example.

The housing 10 preferably includes a tubular portion 11, an impeller accommodating portion 12, and a handle portion 13. The tubular portion 11 surrounds a blowing axis 91, and extends in an axial direction to assume a tubular shape. The tubular portion 11 includes an air outlet 61 at a front end thereof. The impeller accommodating portion 12 is positioned rearward of the tubular portion 11. An interior space of the tubular portion 11 and an interior space of the impeller accommodating portion 12 are in communication with each other. The handle portion 13 extends radially outward, with respect to the blowing axis 91, from a junction of the tubular portion 11 and the impeller accommodating portion 12.

Referring to FIGS. 1 and 2, according to the present preferred embodiment, the diameter of the tubular portion 11 decreases in an axially forward direction. Note, however, that the diameter of the tubular portion 11 may alternatively be constant or increase in the axially forward direction. In addition, the tubular portion 11 may be perfectly circular or substantially perfectly circular in a cross-section, for example. Alternatively, the tubular portion 11 may have any other desirable shape, such as, for example, an ellipse or a quadrilateral, in the cross-section. Also note that the shape of cross-sections of the tubular portion 11 may be arranged to vary as the cross-section moves in the axially forward direction.

The impeller accommodating portion 12 preferably includes a pair of side surfaces 121 each of which crosses a rotation axis 92 of the motor 30. Each of these side surfaces 121 includes an air inlet 62. During driving of the dryer 1, air is suctioned into the interior space of the impeller accommodating portion 12 through each air inlet 62. Referring to FIG. 1, the shape of each of the air inlets 62 according to the present preferred embodiment preferably is perfectly circular or substantially perfectly circular when viewed along the rotation axis 92. Note, however, that each air inlet 62 may alternatively have any other desirable shape, such as, for example, a polygon, or may alternatively be defined by a large number of small holes. Also note that a filter may be attached at each air inlet 62 in order to prevent dust from intruding into an interior space of the housing 10. Also note that the air inlet 62 may be defined in only one of the pair of side surfaces 121 of the impeller accommodating portion 12 if so desired.

The impeller 20 is configured to rotate about the rotation axis 92 to generate an air current traveling from the impeller accommodating portion 12 toward the tubular portion 11. The impeller 20 is accommodated inside the impeller accommodating portion 12. In addition, the impeller 20 is preferably fixed to a rotor of the motor 30. The impeller 20 includes a plurality of blades 21 preferably having an annular shape with the rotation axis 92 as a center. According to the present preferred embodiment, each of the blades 21 extends in parallel or substantially in parallel with the rotation axis 92. Note, however, that some or all of the blades 21 may be arranged so as to not be parallel or substantially parallel to the rotation axis 92.

The motor 30 is a mechanism arranged to supply rotational power to the impeller 20. According to the present preferred embodiment, the motor 30 is arranged radially inside of the blades 21 with respect to the rotation axis 92. Once the motor 30 is driven, a torque centered on the rotation axis 92 is produced through magnetic interaction between coils and a magnet located inside the motor 30. The rotor is thus caused to rotate about the rotation axis 92 with respect to a stator of the motor 30. According to the present preferred embodiment, the rotation axis 92 of the motor 30 extends in a direction perpendicular or substantially perpendicular to a plane including the blowing axis 91.

The motor 30 according to the present preferred embodiment preferably is a brushless DC motor, for example. The brushless DC motor has a longer life than a comparable brushed motor because the brushless DC motor is free from deterioration in performance which is caused by a brush wearing out. In addition, it is easier to change the speed of the brushless DC motor than the speed of an AC motor, and it is also easier to reduce the power consumption of the brushless DC motor than the power consumption of the AC motor. Note, however, that a motor according to a preferred embodiment of the present invention may be any desirable motor, such as, for example, a brushed motor or an AC motor instead of a brushless DC motor.

The heater support portion 40 is located inside the tubular portion 11. The heater support portion 40 preferably includes four plate-shaped portions 41, for example, extending in a radial manner with the blowing axis 91 as a center. Each of the four plate-shaped portions 41 extends radially outward from the blowing axis 91 in a straight or substantially straight line in a cross-section perpendicular or substantially perpendicular to the blowing axis 91. In addition, according to the present preferred embodiment, the four plate-shaped portions 41 are preferably arranged at regular or substantially regular angular intervals around the blowing axis 91 in a cross-section perpendicular or substantially perpendicular to the blowing axis 91.

Figure 4:
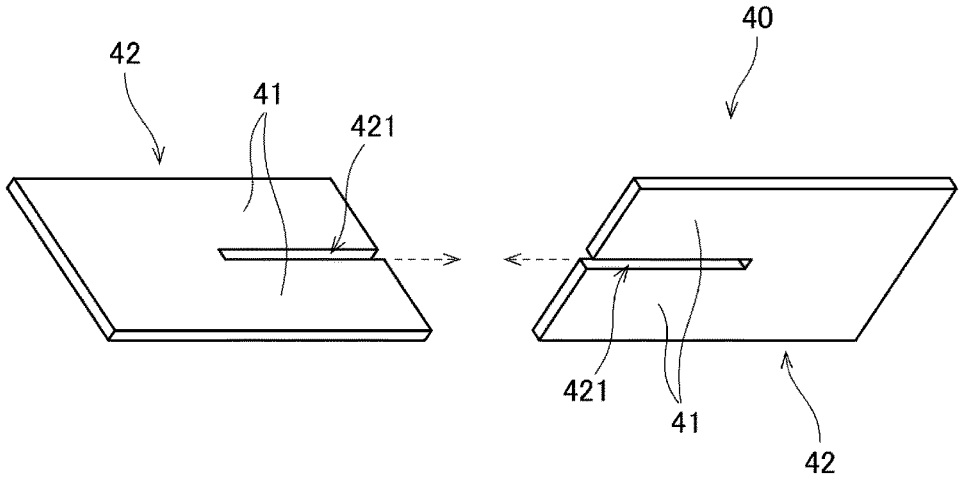
FIG. 4 is an exploded perspective view of a heater support portion according to the above preferred embodiment of the present invention.

FIG. 4 is an exploded perspective view of the heater support portion 40. Referring to FIG. 4, according to the present preferred embodiment, the heater support portion 40 is preferably defined by a combination of two support plates 42. The two support plates 42 are preferably fixed to each other by, for example, fitting cuts 421 defined in both the support plates 42 to each other. Each support plate 42 preferably includes a pair of the plate-shaped portions 41 extending to mutually opposite sides with respect to the blowing axis 91. Thus, the four plate-shaped portions 41 are arranged at angular intervals of 90 or approximately 90 degrees around the blowing axis 91. A reduction in the number of parts of the heater support portion 40 can be achieved by combining the support plates 42, each of which includes the pair of plate-shaped portions 41 as described above. Note, however, that each of the plate-shaped portions 41 may alternatively be defined by separate members if so desired.

The heater 50 is a heat source used to heat an airflow generated by the impeller 20. A heating wire, such as, for example, a nichrome wire, which generates heat when energized, is preferably used as the heater 50. The heater 50 is located inside the tubular portion 11, and is supported by the heater support portion 40. Specifically, the heater 50 is preferably retained in cutouts defined in the plate-shaped portions 41. Note that the heater 50 may alternatively be wrapped around radially outer edges of the plate-shaped portions 41 such that the heater 50 extends across the four plate-shaped portions 41.

Once a power switch of the dryer 1 is turned on, electric current is supplied to both the motor 30 and the heater 50. The motor 30 is thus activated to cause the rotor of the motor 30 and the impeller 20 to rotate about the rotation axis 92. As a result, gas is accelerated by the blades 21, and an airflow traveling from the impeller accommodating portion 12 toward the tubular portion 11 is generated. In addition, the airflow, which is sent forward inside the tubular portion 11, is heated by heat generated in the heater 50. Then, the heated airflow is blown forward out of the tubular portion 11 through the air outlet 61.

Next, a flow of air inside the impeller accommodating portion 12 will now be described below. Referring to FIG. 2, the interior space of the impeller accommodating portion 12 preferably includes a swirl channel 122 extending in a circular or substantially circular arc in a cross-section perpendicular or substantially perpendicular to the rotation axis 92. The swirl channel 122 is positioned on a radially outer side of the impeller 20 with respect to the rotation axis 92. That is, the swirl channel 122 is defined between radially outer edges (hereinafter referred to simply as "outer edges") 211 of the blades 21 with respect to the rotation axis 92 and an inner wall surface of the impeller accommodating portion 12. Once the impeller 20 starts rotating, air suctioned through each air inlet 62 is gathered into the swirl channel 122 by the blades 21. Then, the air is sent toward the tubular portion 11 while being accelerated as indicated by a broken line arrow F in FIG. 2.

The housing 10 includes a tongue portion 14 at a boundary between the tubular portion 11 and the impeller accommodating portion 12. The tongue portion 14 includes an end side 141 which is arranged in closer proximity to an outer circumferential portion of the impeller 20 than any other portion of the housing 10. The tongue portion 14 as described above contributes to preventing an air current indicated by the broken line arrow F from continuing to recirculate around the impeller 20. That is, an airflow generated by the blades 21 is directed by the tongue portion 14 so that the airflow will travel along the blowing axis 91. In addition, the radial width W of the swirl channel 122, i.e., the width of the swirl channel 122 as measured in a radial direction with respect to the rotation axis 92, is configured to gradually increase from a vicinity of the tongue portion 14 along a rotation direction of the impeller 20. As a result, air accelerated by the impeller 20 is efficiently sent into the interior space of the tubular portion 11.

As described above, the dryer 1 according to the present preferred embodiment has a structure configured to increase the volume of air sent by the dryer 1 by efficiently sending air into the interior space of the tubular portion 11. However, an increase in the volume of air sent by the dryer 1 will increase noise caused by interference of an airflow with any member inside the dryer 1. A structure which is configured to reduce such noise will now be described below.

Figure 5:
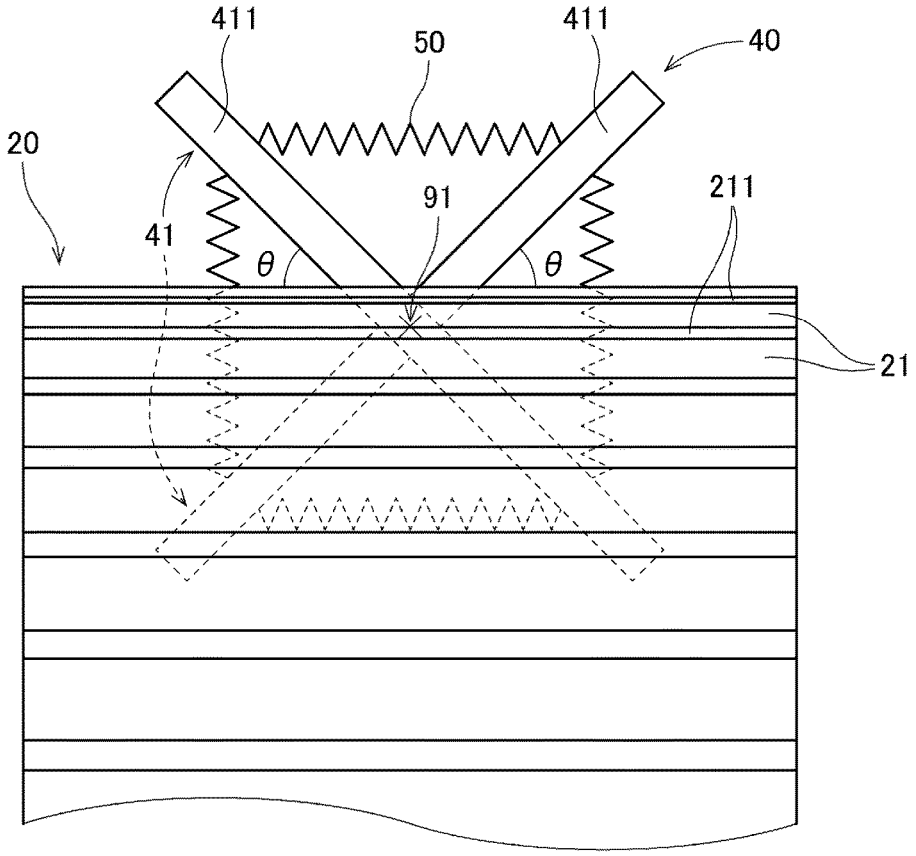
FIG. 5 is a diagram illustrating an impeller, the heater support portion, and a heater according to the above preferred embodiment of the present invention when viewed from a direction indicated by an arrow outline A with a blank inside in FIG. 2.

FIG. 5 is a diagram illustrating the impeller 20, the heater support portion 40, and the heater 50 when viewed along the blowing axis 91 from a direction indicated by an arrow outline A in FIG. 2.

As described above, the impeller 20 includes the plurality of blades 21. According to the present preferred embodiment, the outer edge 211 of each blade 21 is preferably parallel or substantially parallel to the rotation axis 92. Once the impeller 20 starts rotating, gas accelerated by each blade 21 is gathered at a vicinity of the outer edge 211 of each blade 21, and is sent in a centrifugal direction from the outer edge 211 of the blade 21. At this time, an airflow generated by the outer edge 211 of each blade 21 extends along the rotation axis 92.

Meanwhile, in the heater support portion 40 according to the present preferred embodiment, a rear edge 411 of each of all the plate-shaped portions 41 preferably extends in a direction which crosses the outer edges 211 of the blades 21 when viewed along the blowing axis 91. That is, according to the present preferred embodiment, the outer edge 211 of each blade and the rear edge 411 of each of all the plate-shaped portions 41 of the heater support portion 40 are not parallel or not substantially parallel to each other when viewed along the blowing axis 91. Accordingly, an airflow generated by each blade preferably never strikes the rear edge 411 of any plate-shaped portion 41 throughout its entire extent along the rotation axis 92 at the same time. Thus, noise caused by interference of an airflow sent forward from each blade 21 with any plate-shaped portion 41 is significantly reduced or prevented.

Here, it is assumed that N denotes the number of plate-shaped portions 41 included in the heater support portion 40. Then, N preferably is, for example, four according to the present preferred embodiment. When N is an even number, a pair of plate-shaped portions 41 can be defined by a single support plate 42 as described above. However, if N were two, the two plate-shaped portions 41 adjacent to each other would be arranged at angular intervals of 180 or about 180 degrees, and it would be considerably difficult for the heater 50 to extend across the adjacent plate-shaped portions 41. Accordingly, in the present preferred embodiment, N is preferably four as this is the smallest number that allows the heater 50 to be easily supported by using the support plates 42.

In addition, when the number N of plate-shaped portions 41 of the heater support portion 40 is four or an even number greater than four, and the plate-shaped portions 41 are arranged at regular or substantially regular angular intervals around the blowing axis 91, the smallest of angles defined by the blades 21 with the plate-shaped portions 41 when viewed along the blowing axis 91 cannot be greater than about 45 or 45 degrees, for example. According to the present preferred embodiment, N is preferably four, and an acute angle θ defined by a direction in which each of the four plate-shaped portions 41 extends with a direction in which each blade 21 extends when viewed along the blowing axis 91 is approximately 45 degrees, for example. That is, an acute angle defined by each blade 21 with each plate-shaped portion 41 when viewed along the blowing axis 91 is configured to have the greatest possible value. Thus, the noise caused by the interference of the airflow sent forward from each blade 21 with any plate-shaped portion 41 is further reduced.

Figure 6:
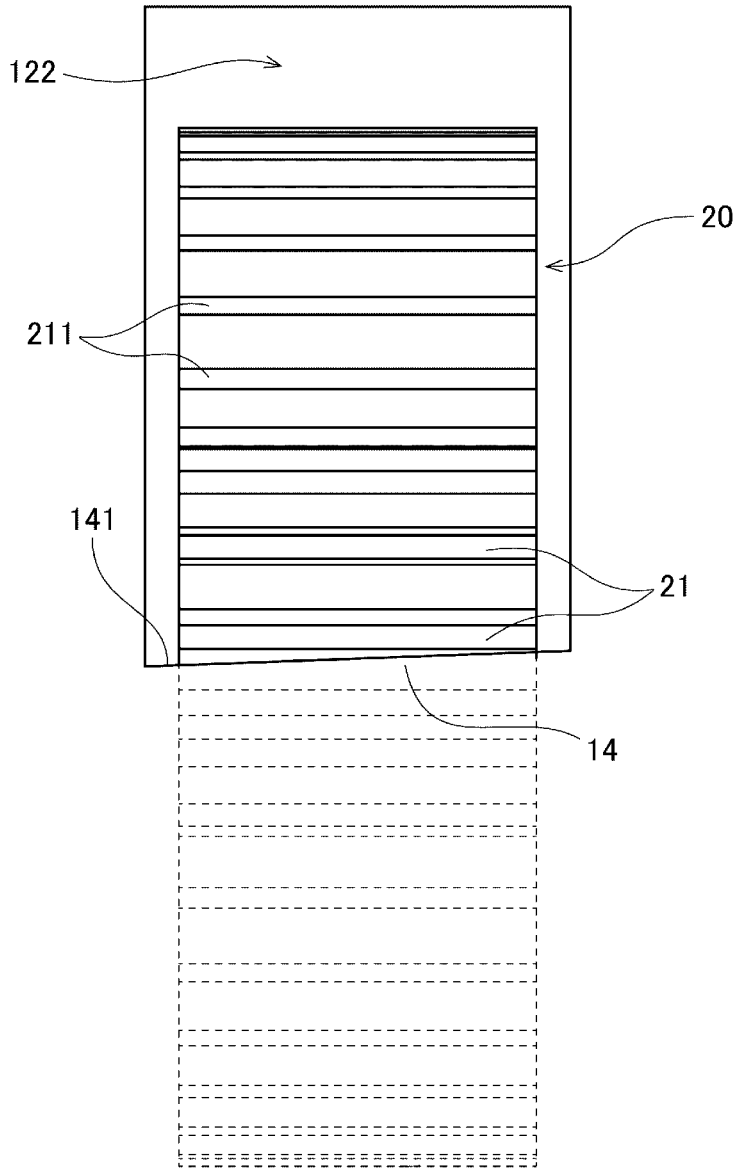
FIG. 6 is a diagram illustrating the impeller and a tongue portion according to the above preferred embodiment of the present invention when viewed from a direction indicated by an arrow outline B with a blank inside in FIG. 2.

FIG. 6 is a diagram illustrating the impeller 20 and the tongue portion 14 when viewed from a direction indicated by an arrow outline B in FIG. 2.

Referring to FIG. 6, according to the present preferred embodiment, the outer edge 211 of each blade 21 and the end side 141 of the tongue portion 14 extend in mutually different directions. That is, the outer edge 211 of each blade and the end side 141 of the tongue portion 14 are not parallel or not substantially parallel to each other. Thus, individual portions of the airflow generated by each blade 21 preferably never strike the end side 141 of the tongue portion 14 at the same time throughout their entire extents along the rotation axis 92. Thus, the total amount of noise caused by interference of the individual portions of the airflow caused by each blade 21 with the tongue portion 14 is reduced.

While preferred embodiments of the present invention have been described above, it will be understood that the present invention is not limited to the above-described preferred embodiments.

Figure 7:
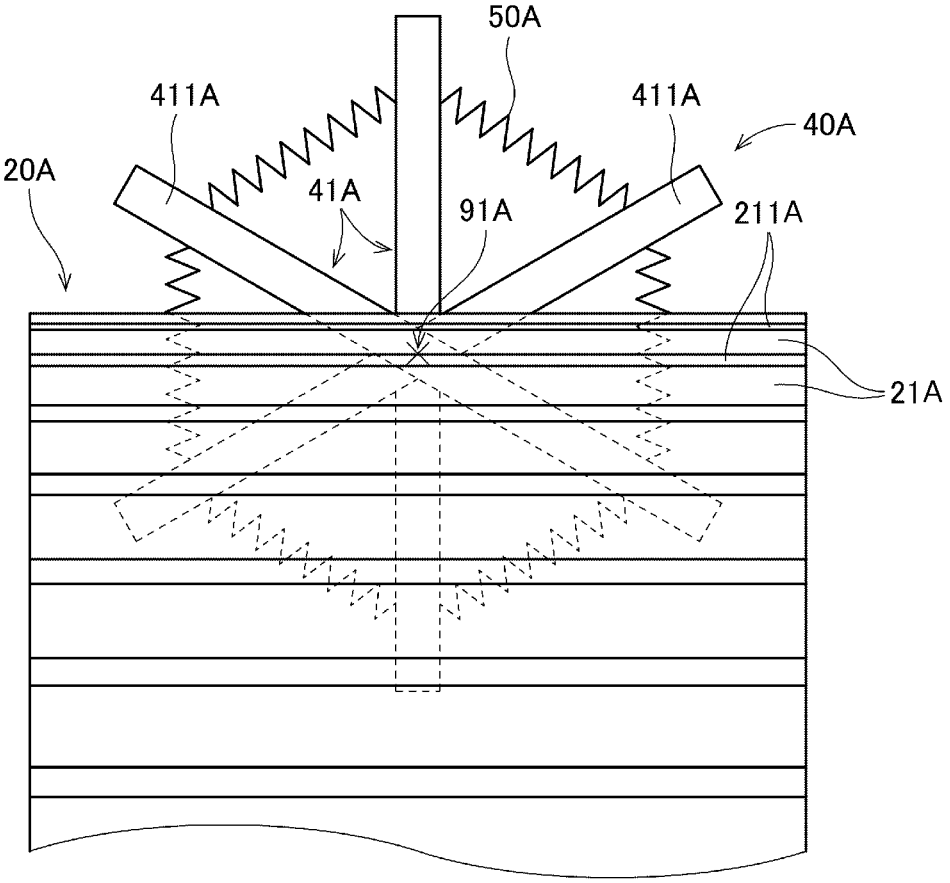
FIG. 7 is a cross-sectional view of an impeller, a heater support portion, and a heater according to an example modification of the above preferred embodiment of the present invention when viewed from the same direction as the diagram of FIG. 5.

FIG. 7 is a cross-sectional view of an impeller 20A, a heater support portion 40A, and a heater 50A according to an example modification of the above-described preferred embodiment when viewed from the same direction as the diagram of FIG. 5. In the modification illustrated in FIG. 7, the heater support portion 40A preferably includes six plate-shaped portions 41A, for example. Accordingly, an angular interval between adjacent ones of the plate-shaped portions 41A is smaller than in the case where the number of plate-shaped portions is preferably four, for example. Therefore, the heater 50A is more stably supported across the adjacent plate-shaped portions 41A.

Also in the modification illustrated in FIG. 7, a rear edge 411A of each of all the plate-shaped portions 41A of the heater support portion 40A extends in a direction which crosses outer edges 211A of the blades 21A when viewed along a blowing axis 91A. That is, the outer edge 211A of each blade 21A and the rear edge 411A of each of all the plate-shaped portions 41A of the heater support portion 40A are arranged not parallel or not substantially parallel to each other when viewed along the blowing axis 91A. Accordingly, individual portions of the airflow generated by each blade 21A preferably never strike the rear edge 411A of any plate-shaped portion 41A at the same time throughout their entire extents along the rotation axis. Thus, the total noise caused by interference of the portions of the airflow sent forward from each blade 21A with any plate-shaped portion 41A is reduced.

Figure 8:
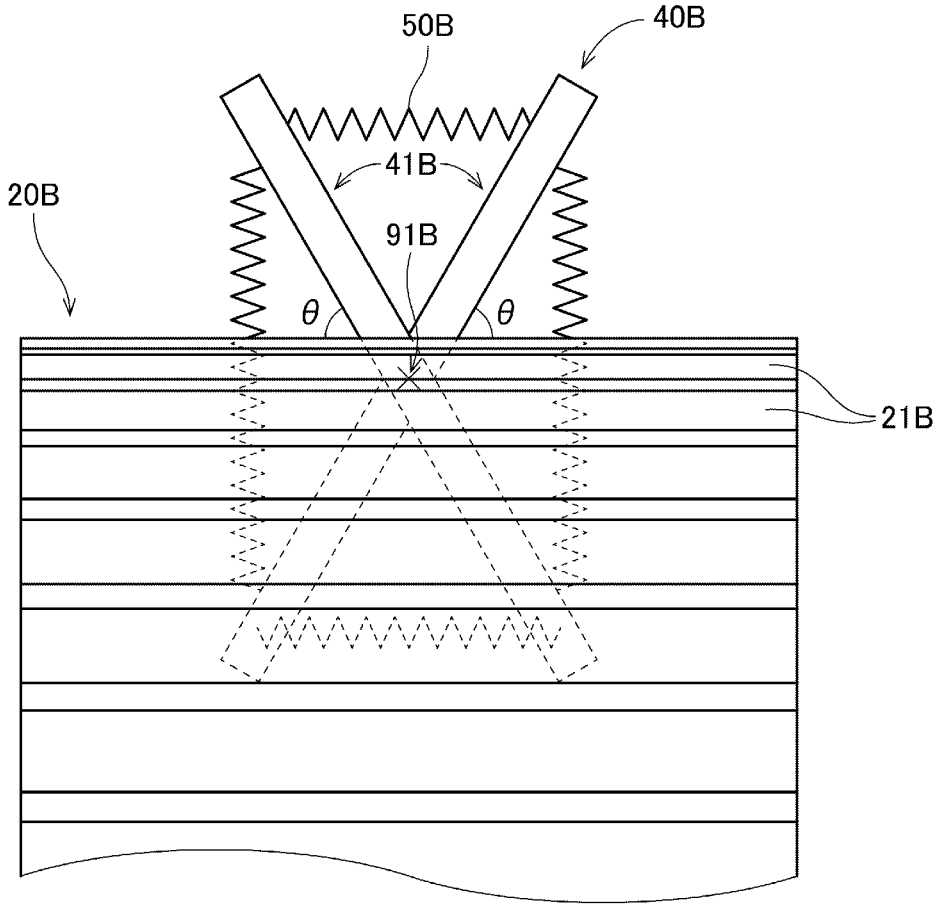
FIG. 8 is a cross-sectional view of an impeller, a heater support portion, and a heater according to an example modification of the above preferred embodiment of the present invention when viewed from the same direction as the diagram of FIG. 5.

FIG. 8 is a cross-sectional view of an impeller 20B, a heater support portion 40B, and a heater 50B according to another example modification of the above-described preferred embodiment when viewed from the same direction as the diagram of FIG. 5. In the modification illustrated in FIG. 8, the heater support portion 40B preferably includes four plate-shaped portions 41B. However, angular intervals between adjacent ones of the plate-shaped portions 41B include small angular intervals and large angular intervals. That is, the four plate-shaped portions 41B are arranged at irregular angular intervals around a blowing axis 91B in a cross-section perpendicular or substantially perpendicular to the blowing axis 91B. This arrangement enables an acute angle θ defined by each of blades 21B with each of all the plate-shaped portions 41B to be greater than 45 or about 45 degrees, for example. Accordingly, the total noise caused by interference of portions of the airflow sent forward from each blade 21B with any plate-shaped portion 41B is further reduced or prevented.

Figure 9:
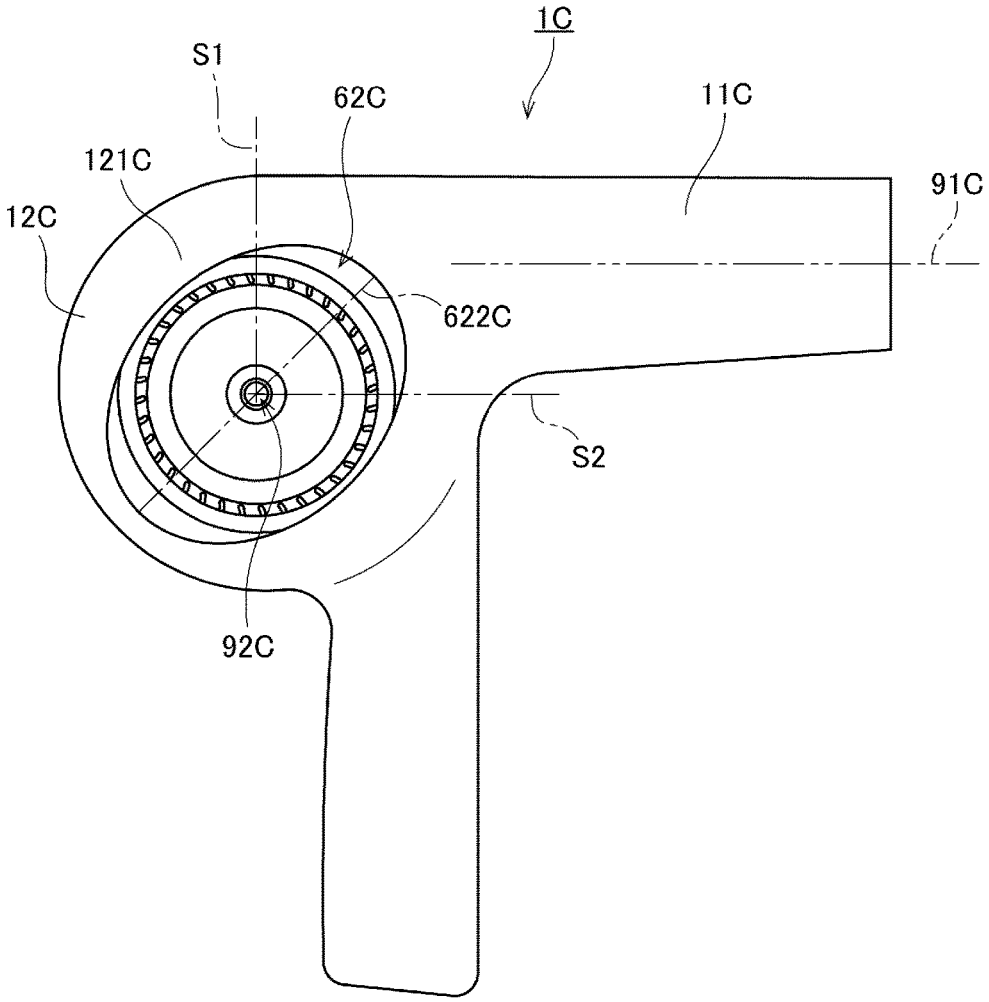
FIG. 9 is a side view of a dryer according to an example modification of the above preferred embodiment of the present invention.

FIG. 9 is a side view of a dryer 1C according to yet another example modification of the above-described preferred embodiment. In the modification illustrated in FIG. 9, a side surface 121C of an impeller accommodating portion 12C preferably includes an air inlet 62C having an elliptical or substantially elliptical shape when viewed along a rotation axis 92C. In addition, in the modification illustrated in FIG. 9, one end of a major axis 622C of the air inlet 62C is close to a tubular portion 11C. Specifically, the one end of the major axis 622C of the air inlet 62C is arranged forward of a plane S1 including the rotation axis 92C and being perpendicular or substantially perpendicular to a blowing axis 91C, and on a side of a plane S2 including the rotation axis 92C and being parallel to the blowing axis 91C closer to the blowing axis 91C. Accordingly, air suctioned through a portion of the air inlet 62C which is in the vicinity of the one end of the major axis 622C is efficiently sent to an interior space of the tubular portion 11C. This results in an increase in the volume of air sent by the dryer 1C.

Note that the detailed shape of any member of the dryer may be different from the shape thereof as illustrated in the accompanying drawings of the present description. Also note that features of the above-described preferred embodiments and the modifications thereof may be combined appropriately as long as no conflict arises.

Preferred embodiments of the present invention and modifications thereof are applicable, for example, to dryers, heat guns, etc.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A dryer comprising:

a tubular portion extending in a front-rear direction around a blowing axis that extends in the front-rear direction;

an impeller accommodating portion rearward of the tubular portion and continuous with the tubular portion;

a centrifugal impeller accommodated inside the impeller accommodating portion;

a motor configured to rotate the impeller about a rotation axis which crosses a plane including the blowing axis;

a heater support portion inside the tubular portion; and a heater supported by the heater support portion inside the tubular portion; wherein the impeller accommodating portion includes a pair of side surfaces, each of which crosses the rotation axis, and an air inlet defined in at least one of the side surfaces;

the impeller includes a plurality of annular or substantially annular blades with the rotation axis as a center;

the heater support portion includes a plurality of plate-shaped portions extending in a plurality of directions from the blowing axis in a cross-section perpendicular or substantially perpendicular to the blowing axis;

a rear edge of each of the plate-shaped portions of the heater support portion with respect to the blowing axis extends in a direction which crosses radially outer edges of the blades with respect to the rotation axis when viewed along the blowing axis;

the air inlet is elliptical or substantially elliptical; and one end of a major axis of the air inlet is forward, with respect to the blowing axis, of a plane including the rotation axis and perpendicular or substantially perpendicular to the blowing axis, and is closer to the blowing axis on a side of a plane including the rotation axis and parallel or substantially parallel to the blowing axis.

2. The dryer according to claim 1, wherein the plurality of plate-shaped portions are arranged at regular or substantially regular angular intervals around the blowing axis in the cross-section perpendicular or substantially perpendicular to the blowing axis.

3. The dryer according to claim 2, wherein the heater support portion includes a plurality of support plates; and each of the plurality of support plates includes a pair of the plate-shaped portions extending to mutually opposite sides with respect to the blowing axis.

4. The dryer according to claim 3, wherein four of the plate-shaped portions are included in the heater support portion; and an acute angle defined by a direction in which each of the four plate-shaped portions extends with a direction in which each blade extends when viewed along the blowing axis is 45 or approximately 45 degrees.

5. The dryer according to claim 3, wherein six of the plate-shaped portions are included in the heater support portion.

6. The dryer according to claim 1, wherein the plurality of plate-shaped portions are arranged at irregular angular intervals around the blowing axis in the cross-section perpendicular or substantially perpendicular to the blowing axis.

7. The dryer according to claim 1, wherein each of the plurality of blades extends in parallel or substantially in parallel with the rotation axis.

8. The dryer according to claim 1, further comprising a tongue portion located at a boundary between the tubular portion and the impeller accommodating portion, the tongue portion including an end side near an outer circumferential portion of the impeller, wherein the end side of the tongue portion and the radially outer edge of each blade with respect to the rotation axis extend in mutually different directions.

9. The dryer according to claim 8, wherein an interior space of the impeller accommodating portion includes a swirl channel on a radially outer side of the impeller with respect to the rotation axis; and a radial width of the swirl channel increases from a vicinity of the tongue portion along a rotation direction of the impeller.

10. The dryer according to claim 2, further comprising a tongue portion at a boundary between the tubular portion and the impeller accommodating portion, the tongue portion including an end side adjacent to an outer circumferential portion of the impeller, wherein the end side of the tongue portion and the radially outer edge of each blade with respect to the rotation axis extend in mutually different directions.

11. The dryer according to claim 10, wherein an interior space of the impeller accommodating portion includes a swirl channel on a radially outer side of the impeller with respect to the rotation axis; and a radial width of the swirl channel increases from a vicinity of the tongue portion along a rotation direction of the impeller.

12. The dryer according to claim 3, further comprising a tongue portion at a boundary between the tubular portion and the impeller accommodating portion, the tongue portion including an end side adjacent to an outer circumferential portion of the impeller, wherein the end side of the tongue portion and the radially outer edge of each blade with respect to the rotation axis extend in mutually different directions.

13. The dryer according to claim 12, wherein an interior space of the impeller accommodating portion includes a swirl channel on a radially outer side of the impeller with respect to the rotation axis; and a radial width of the swirl channel increases from a vicinity of the tongue portion along a rotation direction of the impeller.

14. The dryer according to claim 6, further comprising a tongue portion arranged at a boundary between the tubular portion and the impeller accommodating portion, the tongue portion including an end side near an outer circumferential portion of the impeller, wherein the end side of the tongue portion and the radially outer edge of each blade with respect to the rotation axis extend in mutually different directions.

15. The dryer according to claim 14, wherein an interior space of the impeller accommodating portion includes a swirl channel on a radially outer side of the impeller with respect to the rotation axis; and a radial width of the swirl channel increases from a vicinity of the tongue portion along a rotation direction of the impeller.

* * * * *